United States Patent [19]

Rudolphi

[11] 4,187,868

[45] Feb. 12, 1980

[54] METHOD AND DEVICE FOR CLEANING A SLOPING OR VERTICAL SURFACE ON AN OPTICAL ELEMENT

[75] Inventor: Kjell Rudolphi, Ektorp, Sweden

[73] Assignee: AGA Aktiebolag, Lidingo, Sweden

[21] Appl. No.: 883,282

[22] Filed: Mar. 3, 1978

[30] Foreign Application Priority Data

Mar. 7, 1977 [SE] Sweden ..... 7702537

[51] Int. Cl.[2] ..... B08B 3/12

[52] U.S. Cl. ..... 134/184; 15/250 A; 134/1; 134/34; 134/123; 239/284 A

[58] Field of Search ..... 134/1, 34, 42, 184, 134/174, 123, 150; 239/284 A; 15/250 A

[56] References Cited

U.S. PATENT DOCUMENTS

| | | | |
|---|---|---|---|
| 2,874,316 | 2/1959 | Murdoch, Jr. | 134/1 |
| 3,050,422 | 8/1962 | Zak | 134/1 |
| 3,499,792 | 3/1970 | Veith | 134/1 |
| 3,527,607 | 9/1970 | Antonevich | 134/1 |
| 3,871,395 | 3/1975 | Murry | 134/184 |
| 3,998,653 | 12/1976 | Anthony et al. | 134/1 |

FOREIGN PATENT DOCUMENTS

| | | | |
|---|---|---|---|
| 45-3014 | 2/1970 | Japan | 134/1 |
| 1037787 | 8/1966 | United Kingdom . | |
| 1079732 | 8/1967 | United Kingdom . | |

*Primary Examiner*—S. Leon Bashore
*Assistant Examiner*—George C. Yeung
*Attorney, Agent, or Firm*—Larson, Taylor and Hinds

[57] ABSTRACT

A method and apparatus for cleaning a surface of an optical element, such as germanium or silicon, of a larger arrangement, such as an infra-red camera. Cleaning liquid is applied to the surface and vibrated at a frequency to facilitate cleaning, such as 20–50 kHz. The invention is readily utilized in situations where the optical element frequently becomes dirtied such as in military equipment. A liquid container for the cleaning liquid has an outlet adjacent the surface to be cleaned. A vibrating device is also provided and may be directly on the surface or on a member adjacent thereto. The liquid is applied to the surface and the vibrator is actuated to vibrate the liquid to facilitate cleaning.

10 Claims, 4 Drawing Figures

METHOD AND DEVICE FOR CLEANING A SLOPING OR VERTICAL SURFACE ON AN OPTICAL ELEMENT

The present invention relates to a method of cleaning a surface of an optical element forming part of a larger arrangement, comprising applying a liquid to said surface and causing the liquid to vibrate and a device for carrying out the method.

Optical devices are today finding wider fields of use, particularly optical devices which operate in the infrared range. The use of such a device in a dirtying atmosphere, i.e. an atomosphere in which the device is liable to become dirty, has hitherto been limited to some extent by the fact that it is sometimes difficult to clean the dirt from the outermost transmission surface of the device without scratching said surface. The remainder of the device is, of course, encapsulated in a protective cover, and hence the problem applies to the surface of incidence of the radiation entry aperture, hereinafter referred to as the window surface. This problem is particularly serious in respect of optical devices working in the infrared range, such as infrared cameras, since in order to obtain satisfactory light exchange, the surface of incidence must be provided with an anti-reflective layer. There is often used in the transmitting optical components of an infrared optical device a material, such as germanium or silicon, having a high refraction index, and the transmitted part of the incident radiation is increased through this anti-reflective layer from approximately 50% to 90%. This anti-reflective layer is, however, normally extremely delicate, which eliminates the use of a wind-screen wiper to dry said surface.

Previously, when using such an optical device in a dirtying atmosphere, it has been recommended that the outermost window surface is carefully cleaned manually with a strong cleansing liquid, a mixture of ether and acetone being the liquid most often used, and the window surface then dried carefully with a very soft cloth or the like. Additionally, a stream of air is blown continuously over the window, in an attempt to keep it free from dirt and dust to the greatest possible extent.

A particularlyy serious problem is encountered in this respect with infrared optical devices mounted on field combat-vehicle, since these vehicles are often spattered with mud, some of which reaches the said window surface of the optical device, despite the fact that the device is placed in a shielded position. Obviously a dirty window surface cannot be carefully dried manually whilst the combat vehicle is in action, and hence a dirtied infrared device must remain inoperative until the vehicle can be removed from the battle area and the dirtied window surface cleaned. Consequently there has long been the need of a method by which the window surface can be cleansed automatically.

Optical devices, such as infrared cameras, are also sometimes erected at stationary sites in order to take pictures automatically at regular intervals over a long period of time. These stationary sites are often located in a dirtying atmosphere, and difficulties arise in keeping the outermost transmission surface of such a device clean.

The aforementioned problems are resolved by the fact that the invention has the characterising features disclosed in the claims.

The invention is not, of course, limited to solely cleaning transmission surfaces for infrared-radiation, but may also be applied with other surfaces, such as windows or lens surfaces for visible light. The invention can also be applied in respect of the front glass of vehicle lamps.

The method according to the invention is based on spraying the surface to be cleaned with a cleansing liquid and at the same time vibrating said surface at a frequency immediately above the audible range, frequencies between 20 and 50 kHz being found the most suitable. The liquids used may be any of the conventional liquids at present used for cleaning optic surfaces and in conventional ultra-sonic cleansing operations in liquid tanks. Examples of such liquids include water, optionally admixed with a cleansing agent such as Teepol ®, and an anti-freeze agent; Freon; Isopropyl alcohol. Of these liquids water has the greatest increased cleaning effect when used in conjunction with ultrasonic sound, in comparison with simply rinsing the surface in the absence of ultra-sonic sound. But the disadvantage when cleaning windows intended for infrared radiation is that the anti-reflective coating is often of the type which is damaged by prolonged contact with water, and that water is not transparent to infrared radiation, rendering it necessary to remove residual water from the surface after cleaning the same, prior to putting the instrument back into operation. Water, however, is in plentyfull supply and is not inflammable, and these advantages can outweigh the disadvantages. It is not the intention to clean the surface continuously and hence the anti-reflective coating is not constantly in contact with water. The window surface is cleansed when necessary and the water then allowed to evaporate, this evaporation being hastened by heating the window surface over a suitable period of time. The two remaining cleansing agents mentioned above, i.e. Freon and Isopropyl alcohol, have the advantage (a) that the both evaporate rapidly subsequent to cleaning the surface, (b) that they do not unfavourably influence the anti-reflective coating and (c) that they are more transparent to infrared radiation than water. On the other hand, these cleansing agents are relatively expensive and, moreover, their cleaning ability is not increased to the same extent as the cleaning ability of water is increased when vibrating the surface at ultrasonic sound frequencies. Other cleaning agents than those mentioned above are also conceivable.

Since it has been found in ultra-sonic cleaning that the temperature of the cleaning liquid has a great influence on the cleaning result, and that the cleaning effect is not linearly dependent upon the temperature, but that there is for the majority of cleaning liquids a temperature range within which the cleaning effect is optimal, it is suitable that both the cleaning liquid and the window surface have a temperature within this temperature range when cleaning said surface. This temperature range is different for different liquids, but often lies somewhere between 20° C. and 50° C. for those liquids which can be envisaged.

In order to reduce the rate at which the liquid flows over the surface and in order to reduce the amount of liquid consumed, it may be suitable to tilt the optical instrument during a cleaning operation in a manner such that the window surface lies substantially horizontal. The side edges around the window may, furthermore, project outwardly from the window to an extent such that the surface of the liquid during a cleaning operation is sufficiently high to obtain an optimum cleaning effect.

Alternatively, a shutter may be provided which, during a cleaning operation, is moved across the window of the optical instrument so as to form a closed space in front of the window, said space being filled with a cleaning liquid which is caused to vibrate by means of a vibrator which may either be fixed to the window or fixed to a suitable location on a part in contact with the liquid. In this case the window surface need not be tilted.

The invention will now be described in more detail with reference to the accompanying drawings, in which:

FIG. 1 is a sectional view through, and

Figure 1:
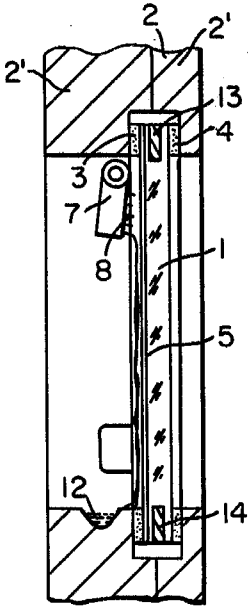

In the Figures there is illustrated a planar window 1 which is resiliently mounted in a holder 2, e.g. in a manner such that a rubber strip 3 and 4 respectively are arranged on both sides of the window and the parts of the holder projecting outwardly over the window on both sides thereof. These strips serve to seal the part of the optical device located inwardly of the window, to the right in FIG. 1, from the ingress of liquid.

Although the illustrated embodiment incorporates a planar window the invention is not limited to such a window but can also be applied to a curved window. During a cleaning operation, however, the surface should be so positioned that liquid covers the whole surface thereof. The window is provided on its outer surface with an anti-reflective coating 5 which is normally sensitive to mechanical wear but which is necessary, particularly in the case of windows for infrared radiation, in order to increase the transmission through the window. In the illustrated embodiment, the window has a curved upper edge, straight side edges and a straight lower edge of which one corner is rounded. At the other, straighter corner of the lower edge there is arranged an ultra-sonic transducer 6, such as a vibrator, which when activated oscillates at a frequency above the audible range, preferably at a frequency between 20 and 50 kHz. The ultra-sonic transducer 6 may, of course, also be placed on the inside of the window. The shape of the window is entirely based on the fact that the surface shall be as small as possible, and many other shapes, e.g. a purely rectangular shape with straight corners, are also conceivable. The holder comprises two parts 2' and 2'' between which the window 1 is fastened by means of screws or the like.

The vibrator 6 may be a piezoelectric device, although other types of ultra-sonic transducers are also conceivable. Since the window is resiliently mounted, a good vibration is obtained over the whole of the window surface.

Arranged adjacent the upper part of the window on the outside thereof is a curved pipe 7 which is provided along the whole of its length with closely arranged orifices 8 which, when seen laterally, are positioned such that pressurised liquid in the pipe flowing out through the orifices 8 is directed obliquely downwardly against the window. Connected to the centre portion of the pipe is an inletpipe 9 which is provided with a controllable valve 10 and which is flexibly coupled to a liquid container 11 so that the liquid in the container flows gravitationally to the pipe.

As an alternative to the illustrated embodiment, liquid from the container can be pumped to the pipe 7, instead of arranging the container at a level higher than the level of the window. In this way a uniform and controllable pressure can be obtained with regard to the liquid transferred. On the under side of the window 1, the holder 2 is provided on the front side thereof with a gently sloping drain 12 and the outside of the edge of the holder 2 connecting with the window is gently curved to provide good drainage from the window and to prevent the occurrence of a pocket of liquid at the under edge of the window.

In the illustrated embodiment, the forward part 2' of the holder 2 has been provided with edges which project a relatively considerable extent from the window 1 and the drain 12 discharges at 12' adjacent the forward part of the holder 2'. By this means, it is possible in the case of a limited supply of liquid and a heavily dirted window surface to tilt the optical instrument doing a cleaning operation so that the window surface is located more horizontally. In this way there is formed a basin for the liquid with the window 1 as the bottom of the basin and the opening of the holder 2' as the side walls thereof. In this way the layer of liquid on the window surface will be deeper and the effect of the ultrasonic vibration greater.

Since the window of the illustrated embodiment comprises silicon or germanium, which is a semi-conductor material, two heating electrodes 13 and 14 are incorporated in the material along two opposing edges, the upper and the lower edges in the illustrated embodiment, although, of course, the electrodes may also be placed along the side edges. A thermostat 15 is mounted on the forward side of the window and is coupled in series with the electrode 13, and the ends of the thermostat 15 and the switch 16 remote from respective electrodes are each coupled to a respective terminal of a voltage source 17, such as a battery.

The liquid container 11 is also provided with heating means, which means in the illustrated embodiment comprises a heating coil 18 which is wound around the container and which is connected in series with a thermostat 19 adapted to detect the temperature of the liquid present in the container 11.

Coupled in series with the coil 18 and the thermostat 19 is a controllable switch 20. A voltage source 21 is coupled over the coil 18 and the switch 20.

The window surface is cleaned in the following manner:

When it is decided that the window surface should be cleaned, the switches 16 and 20 are closed, whereupon both the window 1 and the container 11 with the cleaning liquid therein are heated to a temperature which provides in respect of the cleaning liquids used an approximative optimum cleaning effect when ultrasonic cleaning. This temperature is different for different liquids but often lies somewhere between 20° C. and 50° C. The liquid used may be any one of those substances normally used today for cleaning optical devices by means of ultrasonic cleaning in liquid tanks, such as Freon, isopropyl alcohol or water with different additives. Subsequent to heating, the valve 10 is opened and the vibrator 6 activated and liquid is sprayed through the orifices 8 in the pipe 7 over the vibrating surface 1.

Figure 2:
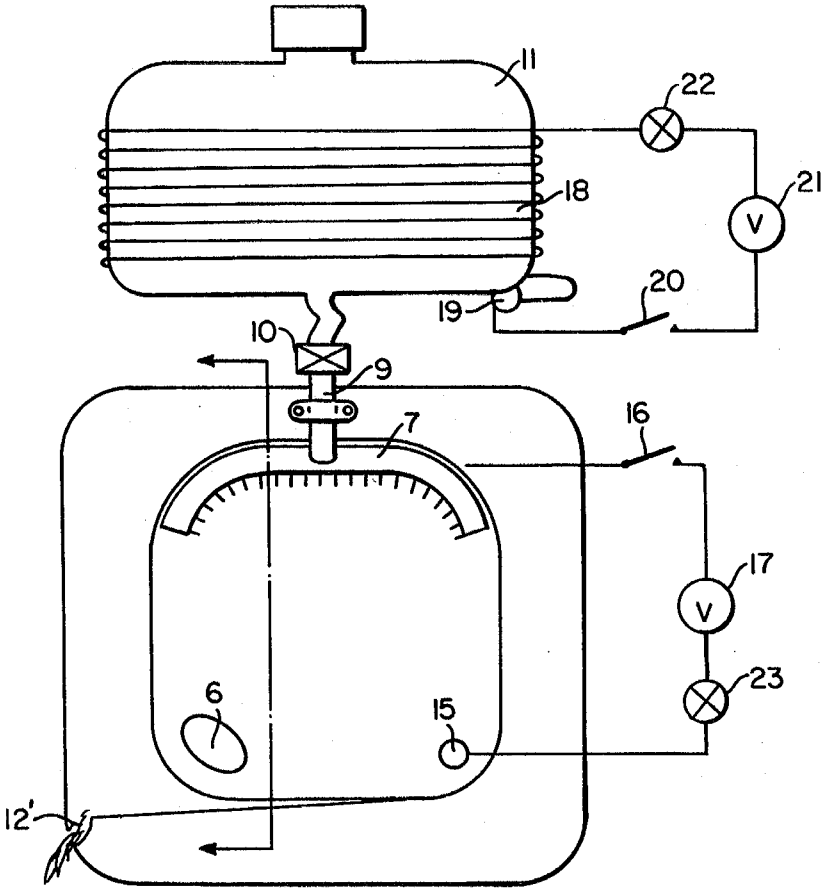
FIG. 2 is a front view of, a window provided with a cleaning device according to the invention.
Figure 3:
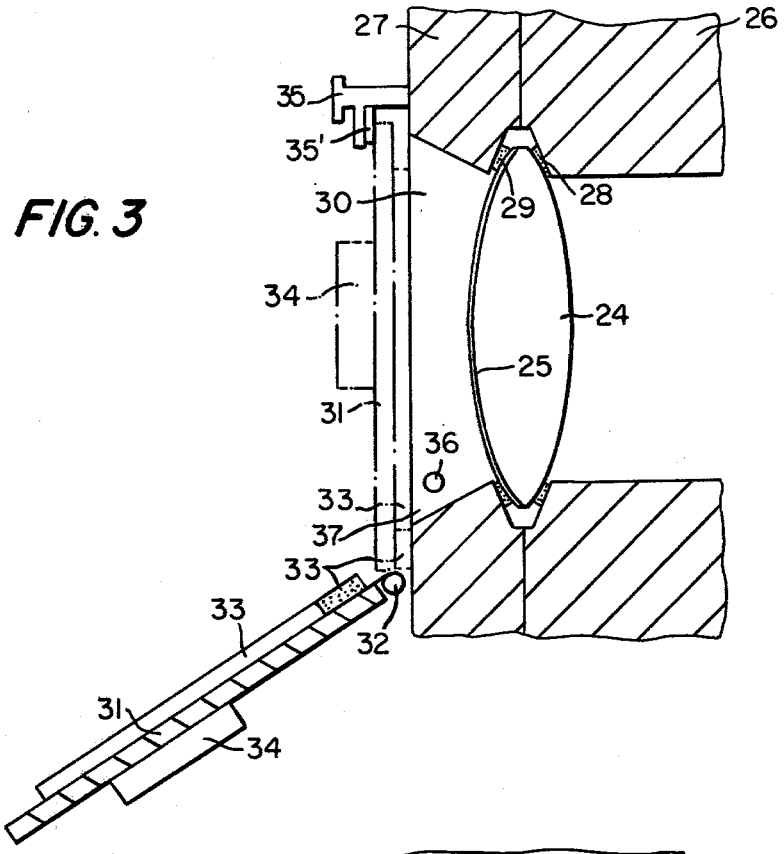
FIG. 3 is a sectional view through, and FIG. 4 a front view of, a further embodiment of the invention.
Figure 4:
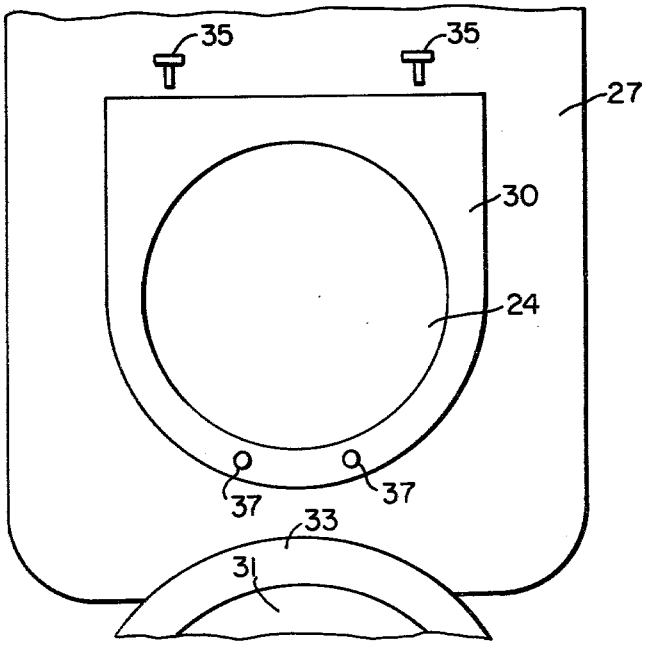

FIG. 3 illustrates a section through and FIG. 4 a partial front view of, a second embodiment of the device according to the invention. In this embodiment there is illustrated a lens 24 having an anti-reflective layer 25, said lens being mounted in a holder 26, 27 having a sealing strip 28, 29 or the like on both sides of the lens, although in this embodiment the strips are arranged such that the mounting is much stiffer than the mounting on the window 1 in FIGS. 1 and 2. The outer part 27 of the holder has an opening 30 which widens outwardly from the lens. As will best be seen from FIG. 4, the under part of the outer part of the opening is round while the upper part is straight.

Arranged in front of the opening is a shutter 31 which is shown in full lines in its open position, i.e. the position occupied by the shutter when no cleaning is taking place. The shutter 30 is mounted to the lower part of the holder part 27 by means of a hinge 32 arranged somewhat beneath the opening. When cleaning is to take place, the shutter 30 is lifted up so as to cover the opening. The shutter is illustrated in its lifted position by dash lines. The shutter has provided on the part thereof facing the holder adjacent its edge a relatively resilient sealing strip 33 for obtaining a good seal in the lifted position of the shutter, said strip 33 extending around the shutter with the exception of the upper part thereof. As mentioned, no strip is mounted on the upper part, but instead there is found here open access to the atmosphere. In this embodiment, the vibrator 34 is arranged on the shutter. Vibrations of the shutter can be transmitted to the space between the shutter and the lens through the resilient strip 33.

When the lens surface is to be cleaned, the shutter is lifted up and held in its lifted position by some convenient means. In the Figure this is shown to be effected by means of a simple knob 35 having a resilient part 35' facing the shutter and being attached to the upper part of the holder part 27, although it will be understood that lifting of the shutter and securing the shutter in the lifted position can be effected by any other suitable means, such as for example some form of hook arrangements or a remote control device in some other conventional manner. It will be understood that the means by which the shutter is held in position shall now obstruct the vibrations of the shutter to any great extent.

Subsequent to lifting up the shutter, the space is filled with cleaning liquid, which in this embodiment is caused to flow in through a pipe 36 which discharges in the lower part of the opening 30 in the holder part 27, whereby the liquid is mixed with air to the least possible extent. In this way the cleaning effect of the liquid is increased in certain cases when subjected to ultra-sonic vibration generated by the vibrator 34 mounted on the shutter, said vibrator 34 being activated for the cleaning operation. The liquid is poured until it covers the lens but not so that the whole of the opening in front of the lens is filled, this being prevented by the fact that the shutter is not provided with a sealing strip at its upper side, but that said strip terminates at a suitable level. In this way there is also formed a space above the surface of the liquid, which is not sealed, which is an advantage when cleaning. When the cleaning operation has been completed, the space is emptied through the pipe 37 which also discharges in the lower part of the opening of the holder part 27, this being effected in this case by means of a pump (not shown) arranged to pump the liquid, via a cleaning filter, back to the liquid container for renewed use.

Many other modifications are conceivable within the scope of the invention. For example, the vibrator may be arranged in different ways, only a vibrating part being in contact with the liquid, and may comprise, for example, a ring arranged in front of the window or lens and having a somewhat larger inner diameter than the outer measurement or the like of the window or lens respectively.

I claim:

1. In an optical device comprising an optical element mounted therein, the improvement which comprises means for cleaning a surface of said optical element, said cleaning means being mounted on said optical device and comprising means for storing a cleaning liquid, means for applying cleaning liquid from said storing means onto said surface of said optical element, means comprising a closure member moveable to a closure position adjacent said optical surface and forming therewith a vessel for containing cleaning liquid applied from said storing means onto the surface of said optical element, and means for vibrating said liquid in said vessel at an ultrasonic frequency to effect cleaning of said optical surface.

2. An optical device according to claim 1 wherein said vibrating means comprises a piezoelectric vibrator operable at a frequency of between 20 and 50 kHz.

3. An optical device according to claim 1 wherein said liquid storing means comprises means for heating cleaning liquid stored therein.

4. An optical device according to claim 1 wherein said optical element comprises semiconductor material.

5. An optical device according to claim 4 wherein said semiconductor material comprises germanium or silicon.

6. An optical device according to claim 1 further comprising mounting means for holding the optical element in said device, said mounting means projecting outwardly of the device and beyond said optical surface, said closure member being pivotally mounted on said mounting means.

7. An optical device according to claim 1 further comprising mounting means for holding the optical element in said device, said mounting means extending outwardly of said device beyond said optical element, and wherein said closure member comprises a shutter member mounted on said mounting means.

8. An optical device according to claim 6 further comprising liquid outlet means for removal of liquid from said vessel pump means, and means to activate said pump to discharge cleaning liquid through said outlet means.

9. An optical device according to claim 1 wherein said vibrating means is mounted on a member adjacent to said surface.

10. An optical device according to claim 1 wherein said optical element comprises a part of an optical device operating in the infrared range.

* * * * *